United States Patent [19]

Chatterson et al.

[11] Patent Number: 4,662,689

[45] Date of Patent: May 5, 1987

[54] LOCK MECHANISM FOR LATERAL FILE

[75] Inventors: Louis M. Chatterson, Kentwood; Thomas McKernan, Grand Rapids, both of Mich.

[73] Assignee: Haworth, Inc., Holland, Mich.

[21] Appl. No.: 733,673

[22] Filed: May 10, 1985

[51] Int. Cl.[4] ..... E05B 65/46

[52] U.S. Cl. ..... 312/219; 70/120; 312/221; 312/333

[58] Field of Search ..... 312/216, 333, 218, 219, 312/221; 292/39, 147, 341.15; 70/120, 66

[56] References Cited

U.S. PATENT DOCUMENTS

| | | | |
|---|---|---|---|
| 78449 | 6/1868 | Gibbs | 70/120 |
| 428,941 | 5/1890 | Pauly, Sr. | 312/221 X |
| 1,324,162 | 12/1919 | Lau | 70/66 |
| 1,422,631 | 7/1922 | Stafford | 312/219 |
| 3,029,118 | 4/1962 | Schuette | 312/221 |
| 3,497,280 | 2/1970 | Olree et al. | 312/221 X |
| 3,589,783 | 6/1971 | Studinski | 312/221 X |
| 3,866,993 | 2/1975 | Dean et al. | 312/216 |
| 3,998,508 | 12/1976 | Scheerhorn | 312/221 |
| 4,239,309 | 12/1980 | De Fouw et al. | 312/219 X |
| 4,240,685 | 12/1980 | Terlecki | 312/221 X |
| 4,352,529 | 10/1982 | Steinke | 312/221 X |
| 4,478,466 | 10/1984 | Clark et al. | 312/221 X |

FOREIGN PATENT DOCUMENTS

| | | | |
|---|---|---|---|
| 393791 | 4/1924 | Fed. Rep. of Germany | 70/120 |
| 1950153 | 6/1970 | Fed. Rep. of Germany | 292/39 |
| 46223 | 4/1936 | France | 70/120 |
| 271055 | 1/1951 | Switzerland | 292/39 |
| 2140 | of 1899 | United Kingdom | 70/120 |
| 23642 | of 1912 | United Kingdom | 292/39 |
| 585442 | 2/1947 | United Kingdom | 70/120 |

*Primary Examiner*—Kenneth J. Dorner
*Assistant Examiner*—Thomas A. Rendos
*Attorney, Agent, or Firm*—Flynn, Thiel, Boutell & Tanis

[57] ABSTRACT

A file cabinet provided with a housing which has a front opening, and which supports thereon a vertically-spaced plurality of drawer units supported for horizontal displacement between open and closed positions relative to the housing. A horizontally elongated but vertically narrow filler panel is positioned within the front opening of the housing between two vertically-spaced drawer units. The filler panel is disposed at a convenient working height which is preferably in the range of 24 to 36 inches above the floor. The filler panel mounts thereon a key-operated lock mechanism which is preferably centrally positioned both vertically and horizontally of the cabinet, and which activates locking bolts which project sidewardly of the cabinet for activating vertically-movable lock bars which are mounted for limited vertical displacement on the insides of the housing side walls. These lock bars having locking elements which engage the closed drawer units to hold them in a locked position. The filler panel can be formed as a posting shelf which itself is horizontally slidably movable between open and closed positions, which posting shelf mounts thereon the locking mechanism.

11 Claims, 12 Drawing Figures

LOCK MECHANISM FOR LATERAL FILE

FIELD OF THE INVENTION

This invention relates to a file cabinet and more specifically to improvements for a lateral file cabinet, which improvements include an improved locking mechanism associated with either a posting shelf or a filler panel.

BACKGROUND OF THE INVENTION

Numerous lateral file cabinets are known which possess the capability of mounting a plurality of slidable drawers, and in many instances the uppermost drawer is replaced with a storage cabinet having an upwardly swingable front door. Such cabinets typically employ a key-operated lock mechanism for securing all of the drawers and doors in a locked position. The lock mechanism typically positions the key-activated rotatable lock plug either along one of the side edges of the cabinet, typically at the upper end thereof, or in the middle of the top rail so as to control vertically-movable locking bars which are slidably mounted adjacent the front corners of the cabinet frame for cooperation with the drawers. This lock mechanism has typically required an intermediate linkage extending between the opposite sides of the cabinet, and such linkage is typically positioned to extend across the upper part of the cabinet housing so as to not interfere with the movable drawers and related structures of the cabinet. This makes such structures more complex, and makes access to the lock plug more difficult in view of its elevation.

Some of the known cabinets have also provided a slidable posting shelf which can be pulled out into a working position when desired. The cabinets which have been provided with such shelves, however, have typically not provided any capability for locking the posting shelf. Further, most known cabinets have not permitted the same basic cabinet structure to be provided either with or without a posting shelf, nor have they permitted the elevational position of the posting shelf to be selectively varied within reasonable limits.

Accordingly, it is an object of this invention to provide an improved file cabinet, particularly a lateral file cabinet, having an improved lock mechanism associated therewith. The lock mechanism is provided substantially centrally of the cabinet between the front vertical edges thereof, and is positioned at a convenient access height located intermediate the upper and lower extremes of the cabinet. The lock mechanism includes a rotary lock plug which is mounted either on a posting shelf or a filler plate which extends horizontally across the front opening of the cabinet between a pair of adjacent shelves. The posting shelf or filler panel can be interchangeably provided, and either can be located at one of several predetermined elevations within the cabinet depending on the size and arrangement of the selected shelves. The rotary lock and a motion transfer mechanism is mounted directly on the filler panel or posting shelf and projects sidewardly therealong closely adjacent the front of the cabinet. The motion transfer mechanism has latch bolts which project sidewardly for cammingly moving and holding the locking bars in their raised locking positions. The improved lock mechanism employs a rack-and-pinion arrangement for connecting the sidewardly projecting latch bolts to the rotary lock plug to maximize the stroke of the latch bolts responsive to the rotative movement of the lock plug.

The improved cabinet of this invention can be provided with a slidable posting shelf, which posting shelf can have the locking mechanism mounted thereon so that the posting shelf is also locked in its closed position when the locking mechanism is activated, or the cabinet can be provided with a filler panel in place of the posting shelf, which filler panel also mounts thereon the same locking mechanism. This selection between the posting shelf and filler bar can be made at any time since both interchangeably fit and removably mount on the cabinet in substantially the same manner to permit utilization of the same cabinet structure and retrofitting of the cabinet with one or the other.

The improved cabinet of this invention also employs an improved housing structure wherein the housing including back and side walls and wraparound front corners all formed in one piece from a single sheet of thin metal plate, with appropriate supporting and reinforcing channels being welded to the inner surfaces of the side walls when the metal plate is still flat so as to facilitate the welding operation, following which the plate is bent to form the rear corners and hence the back and side walls. This thus provides a cabinet having a housing which can be economically constructed, and which housing has smoothly rounded corners which are free of welds so that the housing has a highly desirable appearance. This is particularly significant since cabinetry of this type is often utilized in free standing environments which permit the back of the cabinet to be readily visible.

Other objects and purposes of the invention will be apparent to persons familiar with cabinets of this general type upon reading the following specification and inspecting the accompanying drawings.

Figure 5:
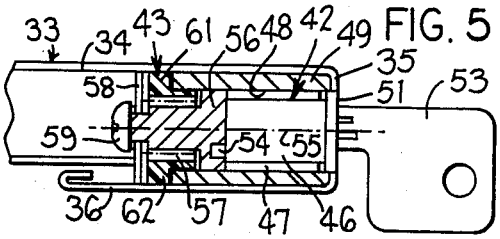
FIG. 5 is an enlarged fragmentary sectional view taken along V—V in FIG. 4, and additionally showing the key inserted into the rotary lock plug.

Certain terminology will be used in the following description for convenience in reference only and will not be limiting. For example, the words "upwardly", "downwardly", "rightwardly", and "leftwardly" will refer to directions in the drawings to which reference is made. The words "front" or "forward" will refer to the side of the cabinet having the drawers accessible therefrom, which "front" side appears in FIG. 1 and is the rightward side of FIG. 2. The words "inwardly" and "outwardly" will refer to directions toward and away from, respectively, the geometric center of the cabinet and designated parts thereof. Said terminology will include the words specifically mentioned, derivatives thereof, and words of similar import.

DETAILED DESCRIPTION

Figure 1:
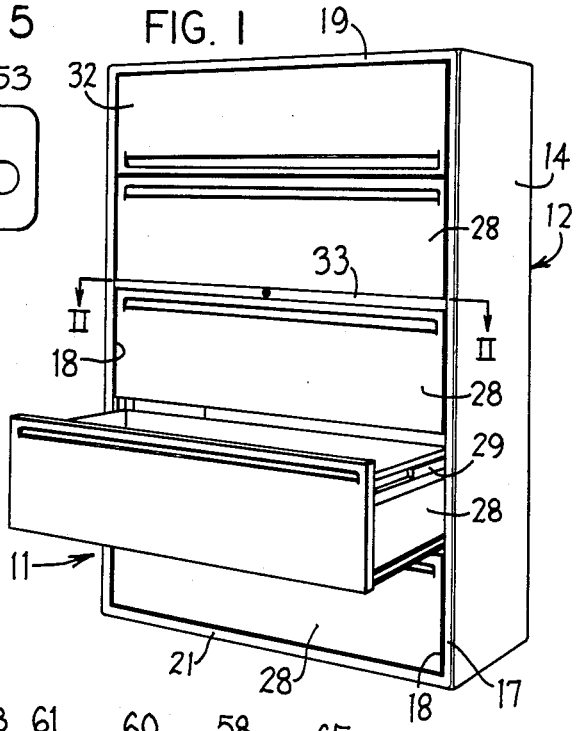
FIG. 1 is a perspective view of a lateral file cabinet according to the present invention.
Figure 2:
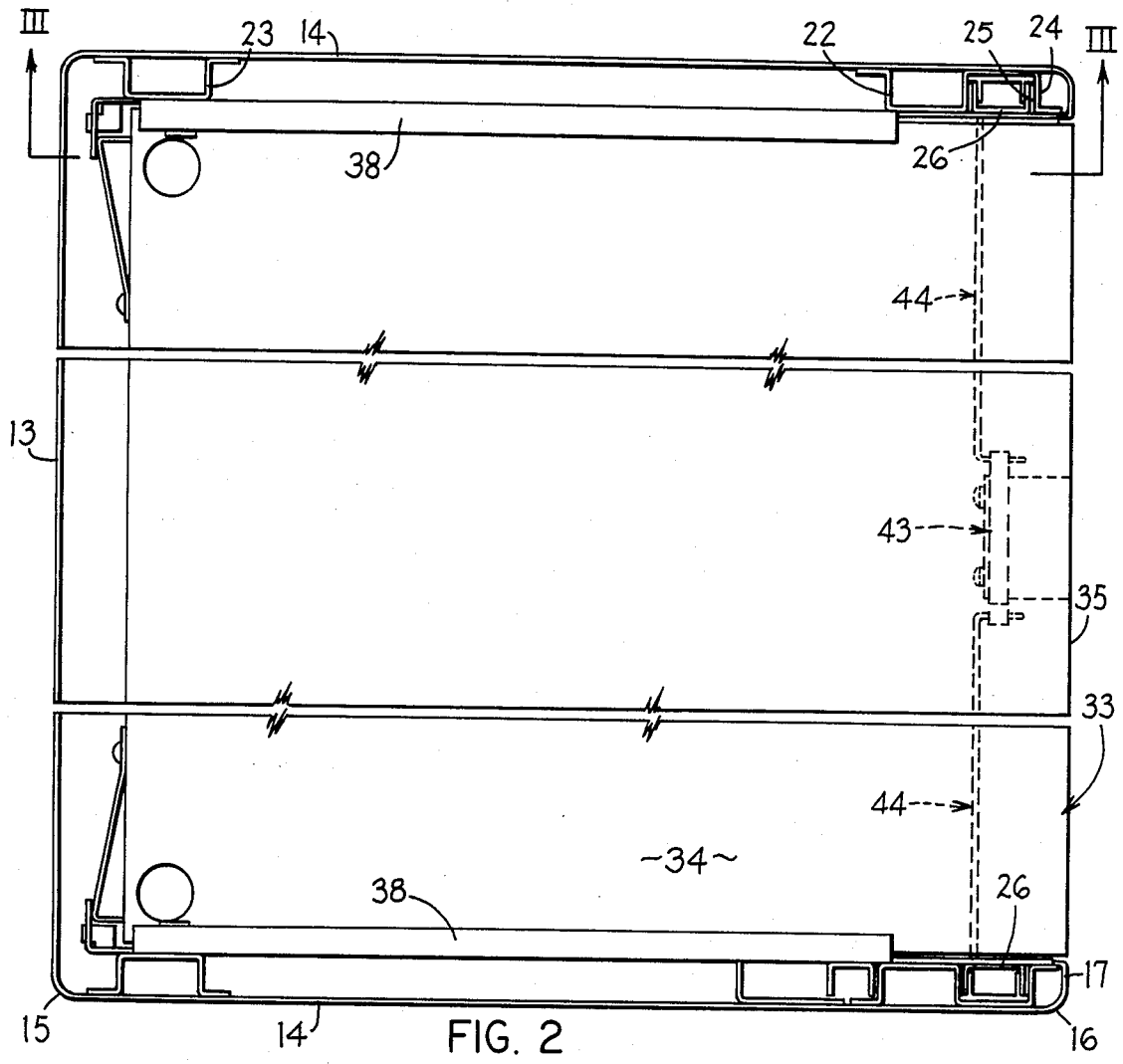
FIG. 2 is a sectional view through the cabinet directly above the posting shelf, this view being taken substantially along line II—II in FIG. 1.
Figure 3:
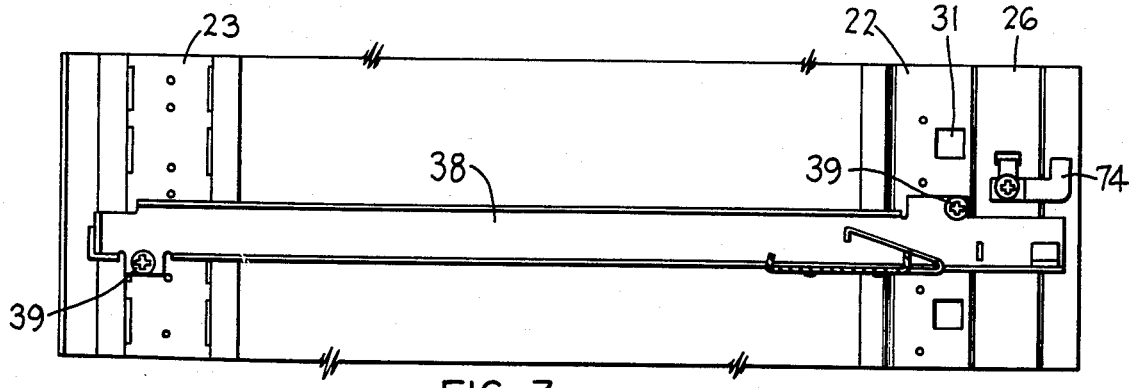
FIG. 3 is a fragmentary sectional view taken substantially along line III—III in FIG. 2 but with the posting shelf removed for purposes of illustration.

Referring to FIGS. 1-3, there is illustrated a lateral file cabinet 11 according to the present invention. This cabinet 11 includes a boxlike housing 12 having a substantially planar back wall 13 and opposed substantially parallel side walls 14, the latter joined to the back wall by small rounded corners 15. The side walls 14, at their forward edges, are rounded at 16 to form the front corners, and there is thus defined a front wall 17 which in reality comprises a pair of small vertically extending edge strips. The front edge strips 17 define a large front opening 18 therebetween. The cabinet is closed at the upper and lower ends by top and bottom walls 19 and 21, respectively.

Each side wall 14 of the housing has a pair of hat-shaped channels 22 and 23 fixedly secured, as by welding, adjacent the respective front and rear edges thereof. These channels are fixed to the inner side of the respective side wall and extend vertically throughout substantially the complete length of the housing. The front channel 22 is effectively formed as a double reversely-opening channel in that it includes a substantially Z-shaped part 24 which projects forwardly and has the free leg thereof welded to an inturned flange formed on the front wall strip 17. This Z-shaped part 24 defines a vertically-elongated channel-like recess or slot 25 in which is slidably positioned a vertically elongated channel-shaped locking bar 26, as described hereinafter.

The structure of the housing 12, as described above, permits the back wall 13, side walls 14 and front walls 17 to be formed integrally from the single flat piece of sheet metal. The sheet metal is initially formed to provide the rounded front corners 16 and front walls 17 thereon. The channels 22 and 23 are then properly positioned on and fixedly welded to the sheet metal. Thereafter the sheet metal is again formed to create the rear rounded corners 15 and hence define the housing into the desired shape.

The file cabinet 11, as illustrated by FIG. 1, is designed to slidably support thereon a plurality of horizontally-movable drawer units 28 disposed in vertically spaced relationship one above the other. The drawer units 28 can be of varying number and size, such as any combination of standard drawer units which typically would be of 3, 6, 9, 12 and 15 inch heights. Each drawer unit, which is conventional and resembles an upwardly opening box, is provided with a conventional telescopic slide rail structure 29 on the opposite ends thereof, which rail structures 29 have the other ends thereof fixedly but removably attach to the channels 22 and 23. These guide rails 29 are provided with downwardly directed projections which engage within slots or openings 31 formed in the channels 22 and 23, which slots are spaced apart at selected intervals, such as three inch intervals, to permit the guide rails to be mounted as desired in accordance with the sizes of the selected drawer units. The range of sizes (i.e., heights) of the drawer units are hence a whole number multiple of the spacing between these openings 31.

The cabinet 11 illustrated in FIG. 1 is provided with an upwardly swingable door 32 at the upper end of the cabinet, which door is provided for convenience in use in view of the elevation of the upper part of the cabinet when same is of significant height, although such door could be at any desired position. This swingable door 32 is conventional in that it is hinged adjacent its upper edge so the door can swing outwardly and upwardly into an open position. The region behind the door can be used either as a storage region or can be provided with a standard horizontally slidable drawer unit (which in this instance would be minus its front wall).

The cabinet 11 as illustrated by FIG. 1 is also provided with a posting panel or shelf 33 horizontally slidably supported on the housing 12 for movement into an open extended position. This posting shelf 33 is disposed intermediate the height of the overall cabinet, such as between a pair of vertically spaced drawer units 28.

Figure 4:
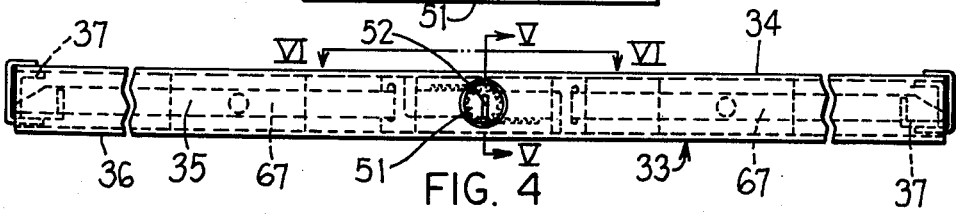
FIG. 4 is a front view of the posting shelf illustrating the locking mechanism mounted thereon.
Figure 10:
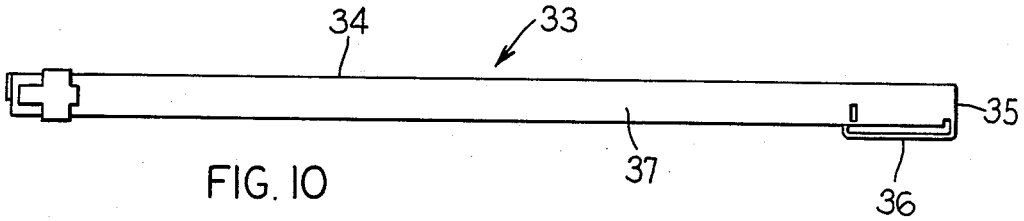
FIG. 10 is a side view of the posting shelf.

Posting shelf 33, when viewed from above (FIG. 2), has a substantially planar top wall 34 of substantially rectangular configuration and sized to occupy a majority of the cross-section of the housing. The posting shelf has a front wall 35 (FIGS. 4 and 10) of only minimal height, such as about one inch, which front wall terminates in a rearwardly projecting flange 36 which forms a partial bottom wall. The sides of the posting shelf are substantially channel shaped as defined by channel-shaped support rails 37 which are fixed to the top 34 and slidably support the opposite sides of the posting shelf within horizontally elongated guide channels 38. These guide channels 38 are fixedly but releasably attached to the side walls of the cabinet, such as by being secured to the channels 22 and 23. These guide channels 38 are secured to the channels 22 and 23 at one of several selected locations, such as at locations which are spaced either 24, 30 or 36 inches from the floor to permit the posting shelf to be positioned at a desired location depending upon the drawer unit selection. The channels 22 and 23 hence have multiple sets of openings associated therewith at the three specified locations so as to permit the guide channels 38 to be fixedly but releasably attached at the desired elevation. The guide channels 38 are fixed to the channels 22 and 23 by releasable fasteners such as screws 39.

The posting shelf 33 mounts thereon a key-operated locking mechanism 41 (FIG. 4-7) for controlling the lock bars 26, which in turn permit all of the drawer units 28 and doors 32 to be locked in a closed position. The lock mechanism 41 includes a conventional key-operated rotary lock 42 which controls a motion transfer mechanism 43, the latter in turn being connected to a pair of elongated lock bolts or bars 44 which project sidewardly of the posting shelf for cooperation with the locking channels 26 as disposed adjacent the opposite side walls of the housing.

The rotary lock 42 includes a conventional rotary plug 46 (FIG. 5) disposed within a shell 47, the latter being fixed within a bore 48 formed in a support block 49. This support block 49 is fixedly positioned directly behind the front wall 35 of the posting shelf and is sandwiched between the top and bottom walls 34 and 36, respectively. The rotary plug 46 has an end face 51 which is accessible through an appropriate opening formed in the front wall 35 so that the lock is hence positioned substantially centrally of the posting shelf. This end face of the rotary plug defines therein a conventional slot 52 for receiving a key 53. The inner or rearward end of the rotary plug is provided with a conventional drive pin 54 projecting axially therefrom in eccentrically positioned relationship. This structure of the rotary plug is conventional and normally requires a rotational displacement of the plug through an angle of 180° between locking and unlocking positions.

The rotary lock plug 46 is coupled to the motion transfer mechanism 43, which latter mechanism includes a driven shaft 56 which is coaxially aligned with the rotary plug and is rotatably supported within the bore 48. This rotary shaft 56 has a recess in which is accommodated the eccentric drive pin 54 so that shaft 56 is angularly displaced in a back-and-forth manner in response to the back-and-forth rotation of the plug during locking and unlocking of the cabinet.

The driven shaft 56 has a pinion or gear 57 formed integrally thereon, which pinion rotates about the longitudinal rotational axis 55 of the lock, which axis substantially perpendicularly intersects the front wall 35 of the posting shelf. Driven shaft 56 has a hub at the rearward end thereof which is rotatably supported on a rear support plate 58, the latter extending between the top and bottom walls of the posting shelf and being secured to the rear of the support block 49 by a pair of screws 59.

The motion transfer mechanism 43 also includes upper and lower elongate gear racks 61 and 62 which are disposed in meshing engagement with the pinion 57 at substantially diametrically opposite sides thereof. These gear racks 61 and 62 are respectively slidably supported on opposed inside surfaces of the support block 49, and the racks are also slidably confined between the support block 49 and the rear support plate 58 so that the individual racks can hence be slidably displaced solely in a horizontal direction which is directed sidewardly toward one of the housing side walls 14. The movement of these racks 61 and 62 is hence substantially parallel with the front wall 35 of the posting shelf.

The rear support plate 58 has raised cantilevered arms 60 that function as flat detent springs. These springs 60 apply slight pressure to the rear sides of the gear racks and engage the inner end of the gear rack when the lock mechanism is in the locked position. This detent spring assists in holding the lock bars 26 in the up or locked position.

Each of these linear gear racks 61 and 62, at the outer end thereof, is provided with a vertically projecting arm 65 whereby the overall gear rack hence has a substantially L-shaped configuration. The vertical arm 65 has a vertically elongated slot 66 extending therethrough, which slot permits each of the gear racks to be respectively coupled to one of the lock bolts 44.

Each lock bolt 44 includes a main finger part 67 which is horizontally elongated and extends substantially parallel to but spaced inwardly from the rearward side of the posting shelf front wall 35. This main part 67, at its inner end, it provided with a forwardly projecting arm or drive part 68 which extends at an angle of substantially 90° with respect to the main part 67. This drive part 68 extends through the slot 66 of a respective gear rack so that the main part 67 hence extends substantially in the same direction as the respective gear rack and is linearly movable therewith in a reciprocating manner. The main part 67 of each lock bolt 44 is provided with a cam or wedge part 69 (FIG. 8) at the free end thereof. This cam or wedge part 69 is normally positioned within and slidably supported by the respective side rail 37 of the posting shelf. For this purpose, an inner flange of the side rail 37 has an upright slot 71 formed therein for slidably confining the main part 67 so as to maintain it in an upright position while at the same time slidably supporting the main part 67 for linear back-and-forth movement as indicated by the arrow in FIG. 8. The outer wall of rail 37 also has a vertically elongated slot 72 formed therethrough in alignment with the slot 71, whereby the free end or nose of wedge part 69 can hence project through the slot 72 when the locking mechanism is activated.

Figure 8:
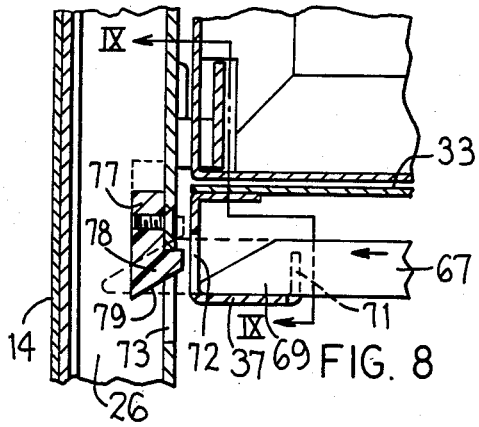
FIG. 8 is an enlarged fragmentary sectional view illustrating the slidable support of the free end of the lock bolt and its cooperation with the adjacent vertically-displaceable lock bar, as taken along line VIII—VIII in FIG. 9.
Figure 7:
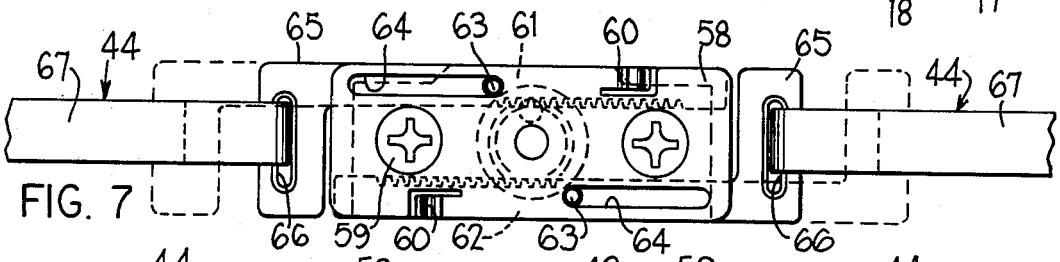
FIG. 7 is a rear view of the lock mechanism as taken substantially along line VII—VII in FIG. 6.
Figure 6:
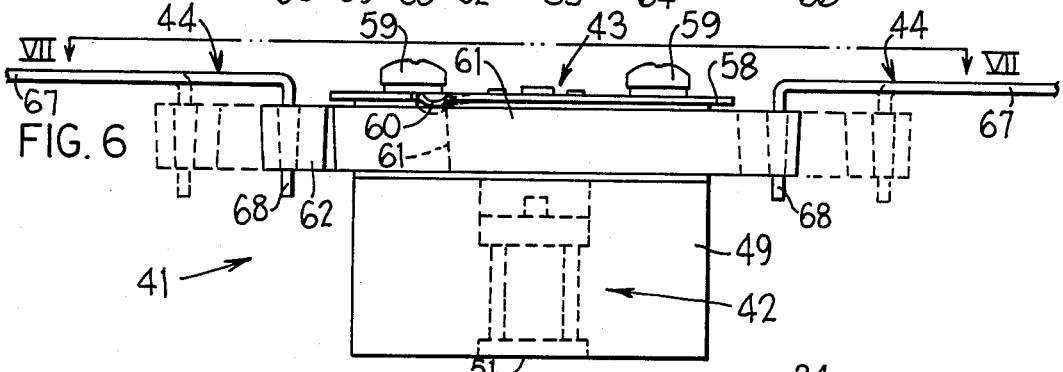
FIG. 6 is an enlarged fragmentary top view taken substantially along line VI—VI in FIG. 4.

The cam part 69, when the lock bolt is moved into its locking position as indicated by dotted lines in FIG. 8, is designed to cammingly cooperate with and project into a vertically elongated slot 73 formed in the base wall of the lock channel 26. This lock channel 26 is normally maintained in a lower most position, such as due to the urging of gravity, when the locking mechanism is unlocked so as to provide free access to the various drawer units 28 and doors 32. When the lock bar 26 is in this lowermost position, the slot 73 therein is spaced downwardly from and only partially overlaps the slot 72. This partial overlap permits the nose end of the cam part 69 to enter into the slot 73 when the lock bar 44 is activated and moved outwardly, whereupon the cam nose 69 then engages the top wall of slot 73 and cams the lock bar 26 upwardly into the locking position indicated by dotted lines in FIG. 8.

As illustrated by FIG. 8, the lock bar 26 is preferably provided with a plastic cam follower member 77 attached to the base wall thereof, as by a screw. Member 77 has a lower part 78 which protrudes through the upper part of slot 73, whereby the sloped bottom wall 79 of part 78 hence effectively defines the upper edge of slot 73 and is slidably engaged by nose part 69 as it moves outwardly. Wall 79 has an incline similar to that of nose 69 to facilitate the upward lifting of channel 26. The protrusion of part 78 through the slot 73 minimizes the spacing from the rail 37, and hence decreases the stroke of nose 69 prior to its lifting engagement with channel 26.

Each locking bar 26 mounts thereon a substantially L-shaped locking finger 74 which projects forwardly and upwardly of the cabinet so as to be disposed directly in front of a rear wall of the drawer unit 28 or door 32 when the latter is in a closed position. The front wall structure 81 (FIG. 9) of the door or drawer unit has an appropriate slot or opening 75 formed in the rear wall 76 thereof through which the finger 74 projects when the door or drawer unit is closed. Hence, when the locking bolt 44 is extended outwardly into the dotted position indicated by FIG. 8, this causes the vertical lock bar 26 to be cammed upwardly, and causes the locking finger 74 to be moved upwardly within the slot 75 associated with the respective drawer unit or door until the upwardly projecting part 82 is disposed in front of the rear wall 76. This hence prevents the drawer unit or door from being moved away from its closed position. The lock bars 26 have a plurality of such locking elements 74 thereon, with two of the elements being associated with each of the drawer units or doors for engaging the lower corners of each drawer unit or door to securely lock the latter in its respective closed position.

Figure 9:
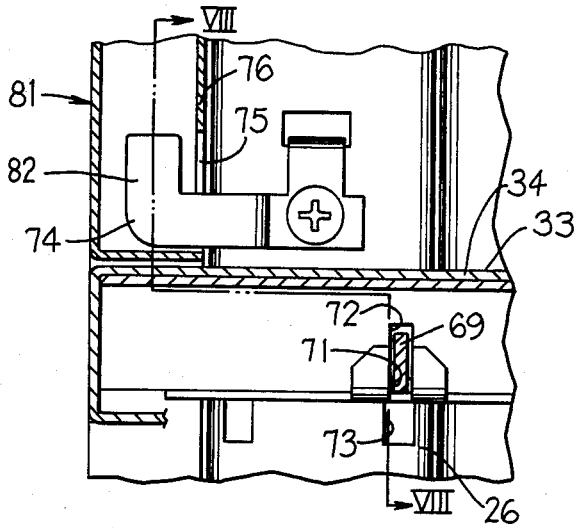
FIG. 9 is a fragmentary sectional view taken substantially along line IX—IX in FIG. 8.

The lock bar 26 as illustrated by FIGS. 8 and 9 preferably has several slots 73 formed therein at vertically spaced locations, such as at locations spaced 24, 30 and 36 inches from the floor, whereby the same lock bolt 44 can hence be utilized to permit the posting shelf to be mounted on the cabinet at any one of several selected heights. Further, each lock bar 26 has two sets of slots 73 formed therein, the two sets being disposed adjacent the opposite side walls of the respective lock bar inasmuch as identical lock bars 26 can hence be disposed adjacent the opposite side walls of the housing.

In situations where use of a slidable posting shelf or panel 33 is not desired, then such shelf 33 can be replaced by a filler panel 85 (FIGS. 11 and 12) which is sized and shaped similar to the posting shelf so as to provide the cabinet with the same overall appearance as illustrated by FIG. 1. In this situation, however, the filler panel 85 is fixedly joined between the opposite side walls 14 of the cabinet.

Figure 11:
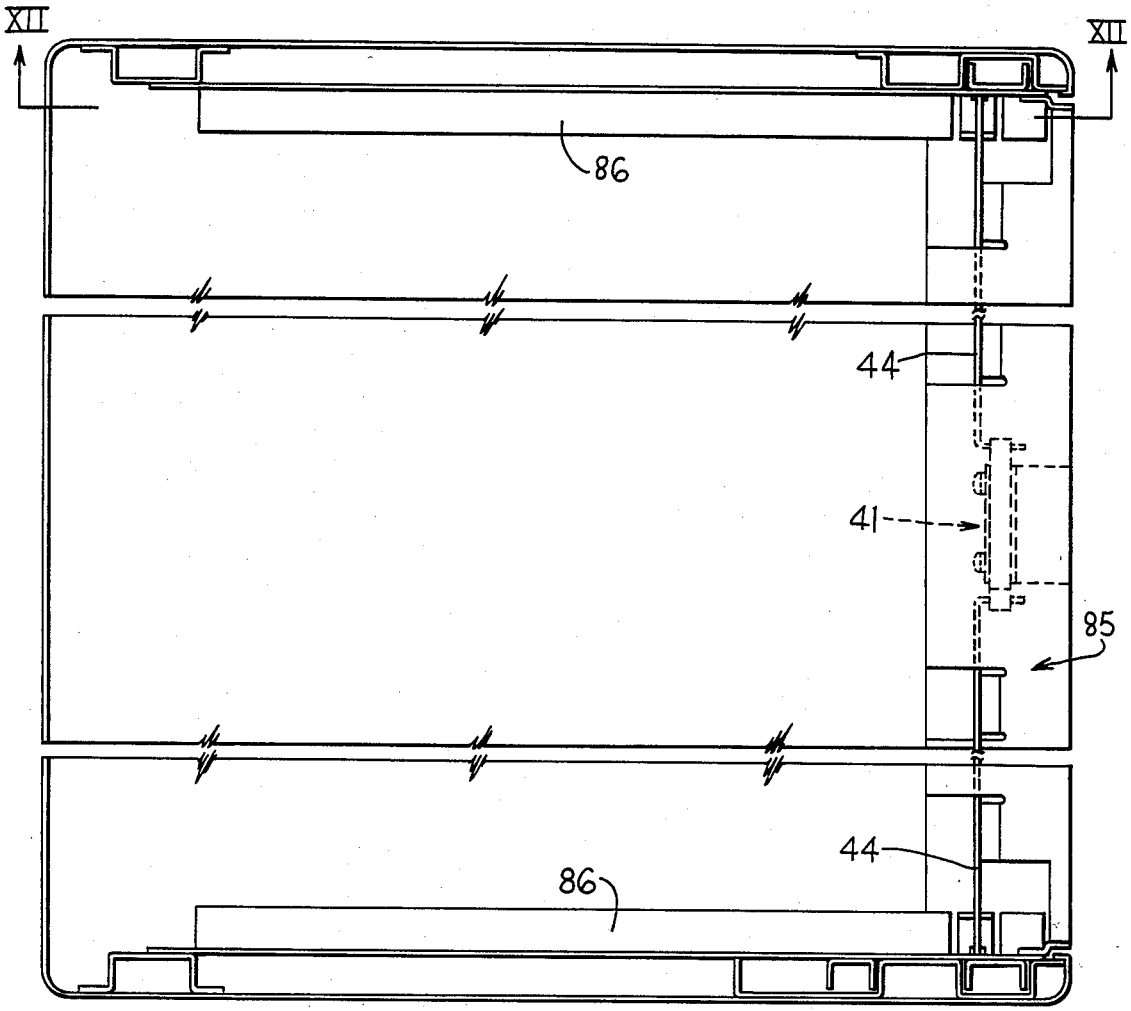
FIG. 11 is a plan view similar to FIG. 2 but illustrating a filler panel mounted in the cabinet in place of a posting shelf.
Figure 12:
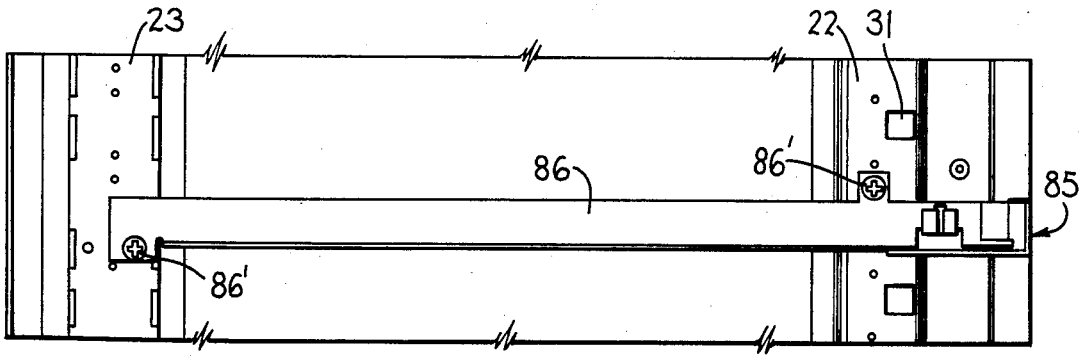
FIG. 12 is a cross-sectional view taken substantially along line XII—XII in FIG. 11.

As illustrated by FIGS. 11 and 12, this filler panel 85 is of a generally channel-shaped configuration which extends across the housing adjacent the front opening thereof so as to occupy the same region which would otherwise be occupied by the posting shelf. The filler panel has rearwardly projecting side rails 86 fixed thereto, which side rails 86 permit rigid mounting of the filler panel 85 to the housing by permitting detachable securement, as by screws 86', to the vertical channels 22 and 23. The filler panel 85 is again of a channel-shaped configuration forming a front wall and rearwardly extending top and bottom walls so as to confine therein a lock mechanism 41 identical to that described above.

Hence, with the improved lateral file cabinet of the present invention, the same basic cabinet can be provided either with a posting or a filler panel, depending upon the desires of the user, and such posting or filler panel can be disposed at any one of several different elevations, depending upon the selection and arrangement of the drawer units. Further, this filler and posting panel mount directly thereon the lock mechanism for the cabinet, with the lock mechanism being centrally located on the cabinet and at an elevation which is disposed upwardly at a convenient work height from the floor, but downwardly a substantial distance from the upper edge of the cabinet. Further, the lock mechanism employs a highly desirable rack-and-pinion motion transfer mechanism which optimizes the conversion of the motion from rotary-to-linear so that this hence maximizes the extension of the locking bolts and hence the camming of the locking bars so as to effect secure locking of the drawer units and doors.

Although a particular preferred embodiment of the invention has been disclosed in detail for illustrative purpose, it will be recognized that variations or modifications of the disclosed apparatus, including the rearrangement of parts, lie within the scope of the present invention.

The embodiments of the invention in which an exclusive property or privilege is claimed are defined as follows:

1. A filing cabinet, comprising:

a housing having back and side walls, the housing having a large opening associated with the front thereof;

a plurality of drawer units disposed vertically one above the other and individually horizontally slidably mounted within said cabinet for movement between open and closed positions, said drawer units when in closed positions effectively closing off said opening;

a pair of vertically elongated locking bars slidably mounted on the inside of said housing and being vertically movable between locking and unlocking positions, one of said locking bars being slidably vertically mounted adjacent a front edge of each said side wall;

a plurality of locking elements mounted on said locking bar in vertically spaced relationship and positioned for respective engagement with a selected drawer unit to securely hold the drawer unit in its closed position when the locking bar is in said locking position, the locking elements being disengaged from the respective drawer units when the locking bar is in said unlocking position;

horizontally elongated filler panel means positioned vertically between two vertically adjacent drawer units, said panel means being disposed substantially within said opening and extending horizontally there across between said side walls, said panel means having a vertical height which is only a small fraction of the vertical height of the adjacent drawer units, said panel means having a front wall which is substantially coplanar with the front walls of the drawer units when the latter are in their closed positions;

releasable securing means cooperating between said panel means and said housing for permitting said panel means to be mounted on said housing at any one of at least three predetermined elevational positions which are spaced upwardly a substantial distance from the bottom of said cabinet but are similarly spaced downwardly a substantial distance from the top of said cabinet, said securing means permitting said panel means to be demounted from said housing and repositioned at one of the other predetermined elevational positions, said securing means including first means defined on the side walls of said housing at each of said three predetermined elevational positions and second means on opposite ends of said panel means for fixed but detachable attachment to one of said first means;

a key-activated locking mechanism mounted on said panel means and coacting with said locking bars for controlling the vertical movement thereof into and out of said locking position;

said locking mechanism including a key-operated rotary lock unit mounted on said panel means, said rotary lock unit having a key-activated rotary lock plug which is positioned directly behind and accessible through the front wall of said panel means, a pair of elongated locking bolts positioned adjacent but rearwardly of the front wall of said panel means and extending sidewardly thereof in opposite directions from said rotary lock unit toward the opposite side walls of the housing for activating engagement with said locking bars, said locking bolts being interconnected to said rotary plug for linear displacement sidewardly of said panel means between locking and unlocking locations in response to rotation of said rotary plug, said locking bolts when in said unlocking locations being retracted sidewardly within said panel means, said locking bolts when in said locking locations projecting sidewardly outwardly beyond the ends of the panel means for engagement with the respective locking bars, and a plurality of bolt-receiving opening means defined on each said locking bar in vertically spaced relation corresponding to said three predetermined elevational positions, whereby said locking bolt when in said locking location projects sidewardly beyond said panel means for engagement with one of said opening means.

2. A cabinet according to claim 1, wherein said locking mechanism includes a rotary-to-linear motion transfer mechanism connected between said rotary lock plug and said locking bolts wherein said motion transfer mechanism comprises a rack-and-pinion mechanism including a pinion which is nonrotatably coupled to said rotary lock plug and is engaged on substantially diametrically opposite sides thereof with a pair of linearly-movable elongated gear racks, each of said gear racks being aligned with and coupled to an end of a respective one of said locking bolts for causing simultaneous linear displacement of said bolts in opposite directions in response to rotational displacement of said pinion by said lock plug.

3. A cabinet according to claim 2, wherein each said locking bolt adjacent the outer free end thereof is provided with a wedgelike nose portion which projects into one of said opening means formed in the adjacent locking bar for effecting a cammed vertical displacement of the locking bar into its locked position in response to an outward linear displacement of the respective locking bolt.

4. A cabinet according to claim 3, wherein said panel means comprises a posting shelf which is slidably supported on and within said housing for horizontal slidable displacement between open and closed positions;

said locking mechanism being mounted on and wholly carried by said posting shelf; and said locking mechanism being activated when said posting shelf is in its closed position so as to also hold said posting shelf in a locked closed position.

5. A cabinet according to claim 1, wherein said panel means comprises a posting shelf which is slidably supported on and within said housing for horizontal slidable displacement between open and closed positions;

said locking mechanism being mounted on and wholly carried by said posting shelf; and said locking mechanism being activated when said posting shelf is in its closed position so as to also hold said posting shelf in a locked closed position.

6. A cabinet according to claim 1, wherein said housing has the back and side walls thereof formed from an integral thin metal sheet bent so as to provide small rounded corners at the junction between the back and side walls, said side walls also being bent to form small rounded corners which merge into and integrally define a front wall, and a pair of vertically elongated support channels fixedly welded to the inner surface of each said side wall, one of said support channels being welded to the respective side wall adjacent the rear corner thereof and the other said channel being welded to the respective said side wall adjacent the front corner thereof, the channel adjacent the front corner of each said side wall having structure associated therewith for defining a vertically elongated channel-like groove which is spaced adjacent but slightly rearwardly from the front corner of the housing, and said locking bar being vertically slidably positioned within the respective channel-like groove.

7. A cabinet according to claim 1, wherein said panel means is substantially U-shaped and has a pair of horizontally elongated leg parts which are fixed to and project rearwardly from opposite ends of said front wall, said leg parts being detachably secured to said side walls of said housing, and said lock mechanism being accessible through said front wall.

8. A cabinet according to claim 1, wherein said locking mechanism includes a cam element fixedly but detachably secured to a selected one of the opening means of each said locking bar corresponding to the selected predetermined elevational position of the panel means, said cam element being engaged by the locking bolt when the latter is moved into its locking position for causing the locking bar to be cammed upwardly into a locking position which prevents the drawer units from being opened.

9. A cabinet according to claim 8, wherein said locking bolt adjacent the outer free end thereof is provided with a wedgelike nose portion which, when the locking bolt is slidably moved outwardly into a locking position, wedgingly and cammingly cooperates with an opposed wedgelike cam surface formed on the underside of the cam element for effecting a cammed vertical displacement of the locking bar upwardly into said locking position, said cam element being of a plastics material.

10. A filing cabinet, comprising:

the housing having back and side walls, the housing having a large opening associated with the front thereof;

a plurality of drawer units disposed vertically one above the other and individually horizontally slidably mounted within said housing for movement between open and closed positions, said drawer units when in closed positions effectively closing off said opening;

a pair of vertically elongated locking bars slidably mounted on the inside of said housing and being vertically movable between locking and unlocking positions, one of said locking bars being slidably vertically mounted adjacent a front edge of each said side wall;

a plurality of locking elments mounted on said locking bars in vertically spaced relationship and positioned for respective engagement with a selected drawer unit to securely hold the drawer unit in its closed position when the locking bars are in said locking position, the locking elements being disengaged from the respective drawer units when the locking bars are in said unlocking position;

horizontally elongated panel means positioned vertically between two vertically adjacent drawer units, said panel means being disposed substantially within said opening and extending horizontally thereacross between said side walls, said panel means having a vertical height which is only a small fraction of the vertical height of the adjacent drawer units, said panel means having a front wall which is substantially coplanar with the front walls of the drawer units when the latter are in their closed positions;

said panel means comprising a positing shelf which is slidably supported on and within said housing for horizontal slidable displacement between said open and closed positions;

a key-activated locking mechanism mounted on and wholly carried by said posting shelf and cooperating with said locking bars so that movement of said locking mechanism into a locking position effects vertical movement of said locking bars into a locked position, said locking mechanism being manually key-activated when the posting shelf is in its closed position so as to move the locking bars into said locked position while simultaneously effecting locking of the posting shelf in its closed position;

said locking mechanism including a key-operated rotary lock unit mounted on said posting shelf and having a key-activated rotary lock plug which is positioned directly behind and accessible through the front wall of said posting shelf, a pair of elongated locking bolts positioned directly adjacent but rearwardly of the front wall of said posting shelf and extending sidewardly in opposite directions from said rotary lock unit toward the opposite side walls of the housing, said locking bolts being interconnected to the rotary plug for linear displacement thereof sidewardly of said panel means into said locking position wherein the locking bolts project outwardly beyond the ends of the posting shelf for camming engagement with the locking bars, said locking bolts when in a nonlocking position being retracted inwardly within the posting shelf.

11. A cabinet according to claim 10, wherein said posting shelf has the opposite ends thereof horizontally slidably supported on a pair of horizontally elongated guide rails which are fixedly but detachably secured to inner sides of said side walls at any one of a plurality of predetermined elevational positions which are vertically spaced apart relative to the cabinet, and said locking bars having a plurality of bolt-receiving opening means therein in vertically spaced relationship corresponding to said predetermined elevational positions so that one said opening means will be disposed for cooperation with the locking bolts irrespective of the selected mounting position thereof.

* * * * *